United States Patent [19]

Van Ausdall

[11] 4,081,941

[45] Apr. 4, 1978

[54] FLEXIBLE PROTECTIVE COVER SECTIONS, ASSEMBLIES AND FORM SYSTEM

[75] Inventor: James G. Van Ausdall, Englewood, Colo.

[73] Assignee: Ceel-Co, Denver, Colo.

[21] Appl. No.: 733,540

[22] Filed: Oct. 18, 1976

[51] Int. Cl.[2] ..... E02D 5/60; E04C 3/34

[52] U.S. Cl. ..... 52/726; 52/727; 52/728; 52/729; 61/54

[58] Field of Search ..... 52/726–729; 61/54

[56] References Cited

U.S. PATENT DOCUMENTS

| | | | |
|---|---|---|---|
| 1,950,677 | 3/1934 | Hogan | 52/728 X |
| 3,553,970 | 1/1971 | Wiswell | 61/54 |
| 3,798,867 | 3/1974 | Starling | 52/729 X |
| 3,939,665 | 2/1976 | Gosee et al. | 61/54 |
| 3,996,757 | 12/1976 | Liddell | 61/54 |
| 4,019,301 | 4/1977 | Fox | 52/727 |

*Primary Examiner*—J. Karl Bell
*Attorney, Agent, or Firm*—Ancel W. Lewis, Jr.

[57] ABSTRACT

Protective cover sections and sealed assemblies thereof fully enclose structural shapes such as I-beams and the like to protect them against bacterial growth, mildew, corrosion and the like. Each cover section is generally thin-walled, substantially rigid, flexible and tough so as to resist chipping, denting and peeling. Each cover section has flexural joint portions that facilitate adjustment thereof to cover a range of structural shape dimensions. On-site applied assemblies of the cover sections are adaptable to a variety of existing structures and include a pair of cooperating cover sections with opposed edge portions of one connected to edge portions of the other at a pair of opposed, sealed, continuous seams extending along the cover. A cooperating pair of cover sections overlaps a next adjacent cooperating pair of cover sections and these pairs are connected at a sealed, continuous, circumferential seam and the ends of the assembly of cooperating pairs are closed by sealed, continuous, circumferential end seams. The assemblies closely conform to the cross-sectional shape of the structural shape covered and are secured thereto for a relatively close fit. In an adjustable form for making these cover sections one base has a plurality of interchangeable flange-forming sections of different dimensions for forming a cover for a range of flange dimensions.

21 Claims, 10 Drawing Figures

FLEXIBLE PROTECTIVE COVER SECTIONS, ASSEMBLIES AND FORM SYSTEM

FIELD OF THE INVENTION

This invention relates to protective converings and an adjustable form for making same that are particularly suited for use in covering structural shapes and the like.

BACKGROUND OF THE INVENTION

Buildings and like structures have exposed structural shapes such as H-beams, I-beams, channels and the like that are the objects of rust, chemical corrosion and the like. In the past the most commonly used approach for protecting such assemblies has been one or more coatings of paint. However, the use of paint in some situations frequently results in chipping, and in certain chemical processes, paper mills, food processing and the like such chipping is not satisfactory.

One difficulty encountered in providing coverings for structural beams is the wide variation in depth, width and shape of such beams. For example, for a given nominal size of structural shape there is a variation in the depth, flange width and flange thickness and previous coatings also contribute to differing dimensions.

Accordingly, it is an object of the present invention to provide a flexible cover section for structural shapes that flexes or adjusts to accommodate a range of structural shape dimensions and is readily sized to fit specific needs.

Another object of this invention is to provide a novel cover assembly for structural shapes that is readily applied at the job site and is characterized by its being durable, smooth, having an attractive finish, sealed, and capable of being washed down with high pressure cleaners.

A further object of the present invention is to provide an adjustable cover assembly or system to protect steel structural shapes and the like from corrosion as well as present a clean and attractive appearance and avoid the problem of chipping associated with paint like coatings.

Still another object of the present invention is to provide a flexible protective covering for beams that closely conforms to the beam shape and after installation does not readily sag or pull away from the beam.

Yet a further object of the present invention is to provide a novel adjustable form apparatus for making flexible cover sections for protecting structural shapes and the like.

SUMMARY OF THE INVENTION

In accordance with the present invention protective cover sections for structural shapes and the like disclosed are in the form of a unitary body having an intermediate body portion and a pair of oppositely disposed inner side body portions connected to the intermediate body portion by flexural joint body portions. Each inner side body portion extends at an obtuse inside angle in relation to the intermediate body portion and the body flexes at the flexible joint portions upon the application of pressure to change the obtuse angles to adjust to cover a range of structural shape dimensions. A pair of oppositely disposed outer side body portions is connected to associated inner side edges by associated corner body portions, and each outer side portion extends back over and in spaced relation to an associated inner side body portion and extends past the intermediate body portion. Each body is preformed from a flat sheet material, preferably by vacuum forming, and is made of a high impact plastic, such as PVC or ABS, that is thin-walled, tough, substantially rigid and yet flexible, and does not chip.

An assembly covering a beam has a pair of cooperating opposed cover sections of a corresponding size and shape with the outer side body portions of one overlapping the outer side portions of the other and the cooperating pair of cover sections are connected together at a pair of opposed sealed, continuous seams along the beam and are connected to the beam to form a unitary, sealed, cover assembly that generally conforms to the exterior surface configuration of the beam in a circumferential closefitting relationship for protecting the beam against bacterial growth, mildew, corrosion and the like. Assembled cooperating pairs of cover sections are connected end-to-end with a raised end portion of one pair overlapping and connected at a sealed, continuous, circumferential seam to another pair of cooperating cover sections for specific beam length requirements, the assembled pairs being closed at one or both ends by a sealed, continuous, circumferential seam to fully seal off the covered beam. An adjustable form for making these cover sections includes a base and interchangeable flange-forming sections releasably attached to the base for forming a plurality of cover sections for a range of flange dimensions using the same base.

Other objects, advantages and capabilities of the present invention will become more apparent as the description proceeds taken in conjunction with the accompanying drawings, in which like parts have similar reference numerals and in which.

Figure 1:
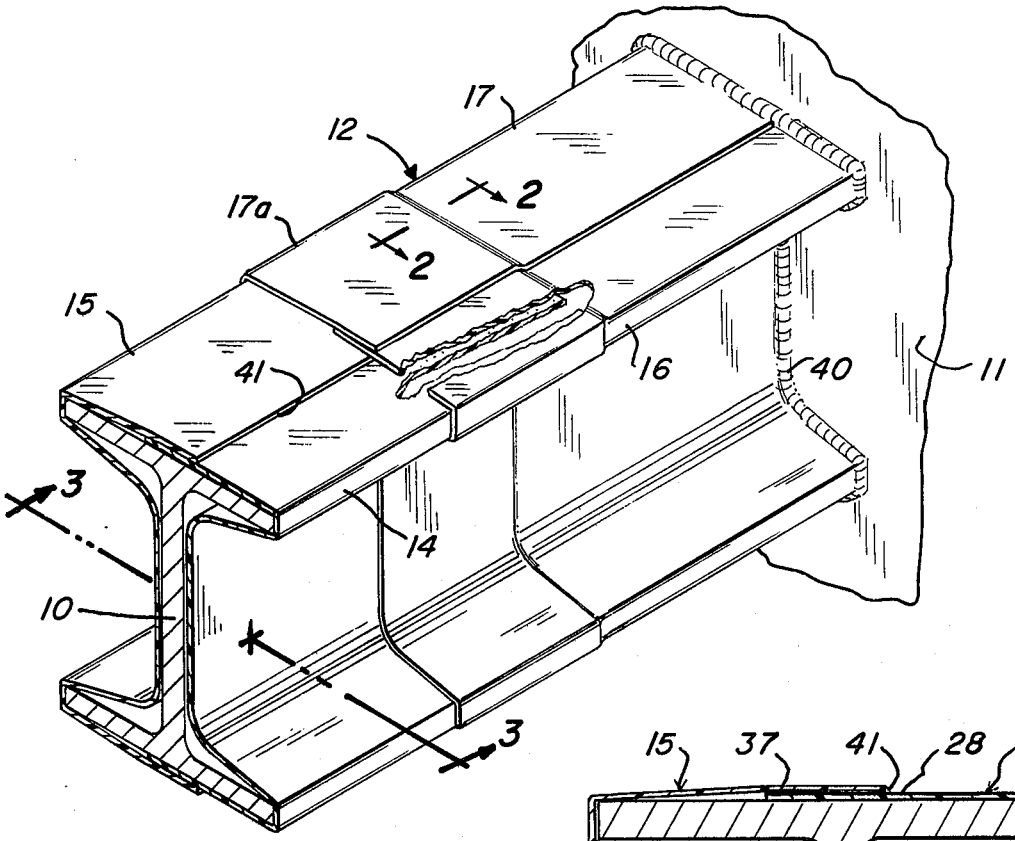
FIG. 1 is a perspective view of a wide-flange beam covered by the cover assembly of the present invention.

Referring now to the drawings, in FIG. 1 there is shown a horizontally disposed structure shape in the form of a wide-flange beam 10 having one end that abuts against a vertical wall 11, the beam 10 being covered by a cover assembly generally designated by the numeral 12. The cover assembly 12 shown in FIG. 1 has a pair of cooperating, opposed cover sections 14 and 15 of preselected lengths encompassing a portion of the full length of the beam 10 and another pair of cooperating, opposed cover sections 16 and 17 encompassing the other portion of the full length of the beam 10. These two cooperating pairs of cover sections are shown connected end-to-end to illustrate the use of multiple pairs of cooperating cover sections for meeting various beam length requirements.

Each cover section of each cooperating pair is of a corresponding size, shape and construction so that a description of one applies to both. Referring now to cover section 14 shown in FIG. 1 and in section in FIG. 3, this cover section 14 is in the form of a unitary, thin-walled body that is substantially rigid and yet flexible and is sized and shaped to substantially conform to the external shape of the beam that it covers. This unitary body has a substantially flat, intermediate body portion 21 for covering the external web surface of the beam and a pair of substantially flat, oppositely disposed inner side body portions 22 and 23 connected to said intermediate body portion 21 by flexural joint body portion 24 and 25, respectively. The flexural joint body portions 24 and 25 are arcuate, being formed along a selected radius. These inner side body portions 22 and 23 project at an obtuse inside angle from opposite edges of the intermediate body 21 and cover the inner external flange surfaces of the side of the beam.

The unitary body of the cover section 14 is further shown to a pair of substantially flat outer side body portions 27 and 28 connected to inner side body portions 22 and 23, respectively, by associated corner body portions 31 and 32, respectively. Outer side body portions 27 and 28 extend back over in spaced relation to an associated inner side body portion for covering an outer flange external surface of the beam. Each outer side body portion extends past the intermediate body portion so that the cover section extends to encompass in excess of one half of the cross section of the beam. Each flexural joint body portion is shown as of an arcuate shape and formed along a selected radius.

The flexural joint body portions of each cover section are capable of flexing under applied pressure to adjust to cover a range of beams having different dimensions. This is illustrated using the same cover section on three different beams and comparing the structures shown in FIGS. 3, 4 and 5 which are somewhat exaggerated for purposes of illustration. The beam 10' of FIG. 4 has a flange depth and flange width that is less than that of the beam 10 of FIG. 3 so that the inside obtuse angle between the intermediate body portion and the inner side body portion of the cover sections is less than that shown in FIG. 3. Conversely, the beam 10'' shown in FIG. 5 has a greater flange depth and greater flange width than that of the beam of FIG. 3 and the inside obtuse angle between portions 21 and 23 of the cover section is greater. It is further noted that in each of the illustrations of FIGS. 3, 4 and 5 there is a gap between the cover section and the juncture of the web and flange of the beam and along at least a portion of the inner external surface of the flange and this gap increases as the depth of the beam being covered increases using the same cover section.

Figure 3:
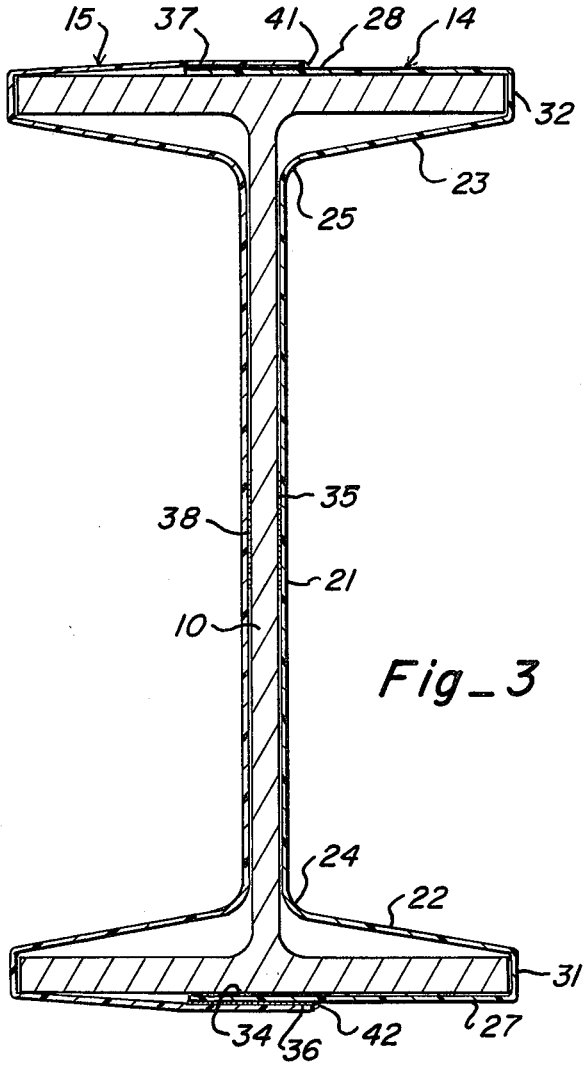
FIG. 3 is a sectional view taken along lines 3—3 of FIG. 2.
Figure 4:
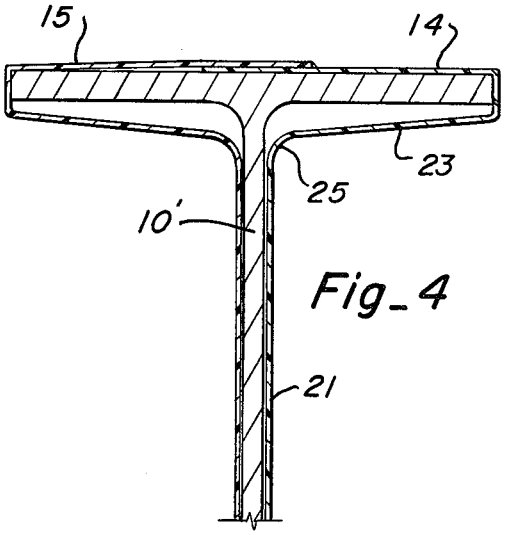
FIG. 4 is a vertical sectional view of the same sized pair of cover sections as that shown in FIG. 1 encompassing a beam having smaller depth and smaller flange dimensions than that of the beam shown in FIG. 3.
Figure 5:
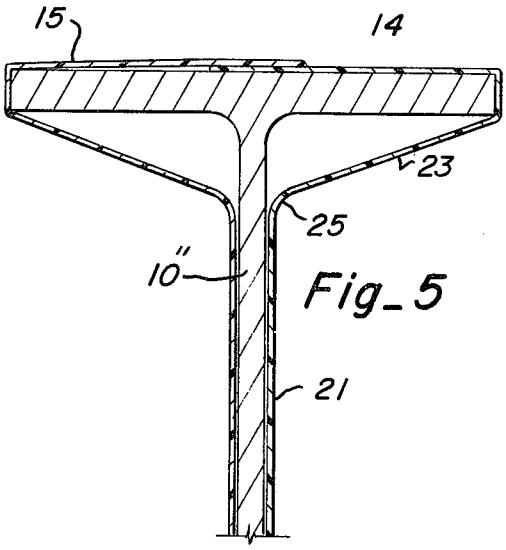
FIG. 5 is a vertical sectional view of the same sized pair of cover sections as shown in FIG. 1 encompassing yet another beam having greater depth and greater flange dimensions than that of the beam of FIG. 3.

An example of the illustrations in FIGS. 3, 4 and 5 may be found by taking a wide-flange beam size W 12 and applying the same size of cover section to either a wide-flange beam identified as the W 12×27, W 12×31, or W 12×36. Each of these beams has a different flange width, thickness and overall depth.

Each cover section is preferably made of a substantially rigid, elastomeric material such as polyvinyl chloride (PVC) or acrylonitrile butadiene styrene (ABS) and has a thickness range between about 0.020 inches and 0.090 inches. This thickness will depend to some extent on the size of the beam being covered and the rigidity and quality of the covering required. This material, which is manufactured in flat sheets, is readily vacuum-formed into the shapes shown. In use this material exhibits a high gloss finish, has high impact characteristics, is tough, does not crack, dent, or peel, and protects against fungus, corrosion, moisture and acid or alkaline conditions.

In assembling the above-described cover sections to enclose the beam 10 shown in FIG. 1 in a sealed airtight enclosure, a fluid adhesive material, preferably a rubber adhesive material, preferably a rubber adhesive sealant, is applied in spots of a limited area along the beam between the bottom surface of the lower flange of the beam and the inside surface of the side body portion 17 as indicated at 34. This adhesive material has a degree of flexibility after it hardens to allow for differing rates of expansion and contraction between the cover section and beam. A similar adhesive material is applied between the exterior surface of the web of the beam and the inside of the intermediate body portion 21 as indicated at 35 to secure cover section 14 to the beam. This is preferably done by placing the adhesive material on the inner surface of the body portion 27 and on the web surface of the beam and then positioning the cover section 21 against the beam. It is understood that any adhesive material that is compatible with the metal beam and the plastic cover section may be used between the beam and cover section.

The other cover section 15, which is the outer or the overlapping cover section of the cooperating pair of cover sections shown in FIG. 3, is secured in place on the beam in the position shown. This is accomplished by applying another fluid adhesive material, preferably made of the same material as the cover sections dissolved in a suitable solvent, the adhesive material being applied in a fluid form. This adhesive material is applied as a continuous, longitudinally extending bead on the external surfaces of the outer side body portions 27 and 28. When the outer cover section 15 is positioned as shown, the beads are flattened and form a continuous seam, as indicated at 36, between the overlapping edge portions covering the lower flange and a seam indicated at 37 between the overlapping edge portions covering the upper flange.

This procedure forms a sealed continuous seam between the cooperating pair of cover sections 14 and 15 throughout the lengthwise extent thereof and, as seen, the sealed cover assembly generally conforms to the exterior surface configuration of the beam thus enclosed. Because the adhesive material forming seams 36 and 37 is preferably of the same material as the cover sections, the assembly formed by the two sections about the beam is essentially unitary or of a monocoque construction. A continuous bead 41 and a continuous bead 42 are shown as securing the edges of the outer cover section 15 to the inner cover section 14 to avoid a rough edge. The material forming beads 41 and 42 is preferably the same as that forming seams 36 and 37.

Figure 2:
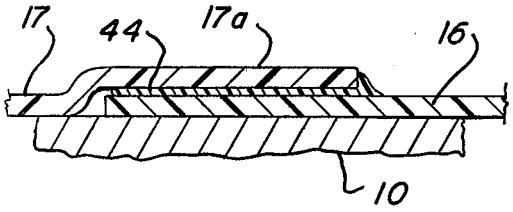
FIG. 2 is a sectional view taken along lines 2—2 of FIG. 1 showing the end-to-end sealed continuous seams.

The next adjacent cover sections 16 and 17 are adhesively secured to the beam and to one another at sealed continuous seams in the same manner as are beams 14 and 15 above described. Prior to insertion in place a circumferentially continuous bead of adhesive material is placed between a raised end portion of the next adjacent cover sections 16 and 17 shown in detail in FIG. 2 at 17*a* and the end portions of sections 14 and 15 and flattened as indicated at 44 to form a circumferential, sealed, continuous seam. Finally, a bead of an adhesive material 40 is applied to the end of the cooperating opposed pair of sections 16 and 17 and end wall 11 to form another sealed, continuous seam to seal and close off the end of the cover assembly 12. The end of assembly 12 opposite bead 40 may also be sealed by a circumferential bead like that of bead 40 at the end of cover sections 14 and 15 and a surface normal thereto to fully close and seal off the beam from the atmosphere as required. The preferred adhesive material for bead 40 is a silicone material that allows for expansion and contraction principally due to temperature changes.

Figure 6:
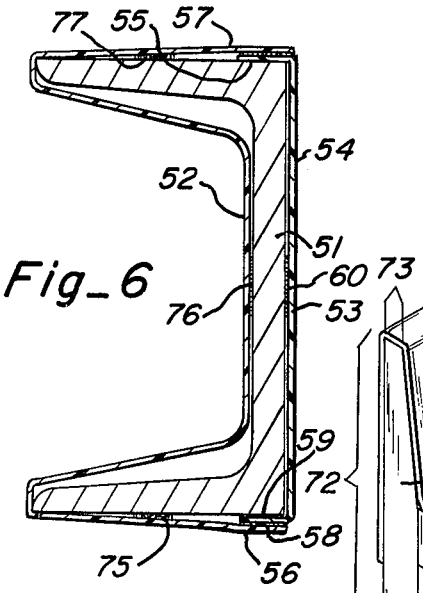
FIG. 6 is a sectional view of a cover assembly for another form of structural shape.

Another form of closure assembly shown in FIG. 6 is shown enclosing a structural channel 51 and this assembly uses a cover section 52 of a similar construction and shape to that shown in FIGS. 1–4 for one side and a cover section 53 with a unitary channel-shaped body having a substantially flat intermediate body portion 54 and a pair of opposed substantially flat side body portions 55 and 56 turned at right angles to the intermediate body portion. Again in the assembly these opposed cover sections have portions which are adhesively fastened to the beam by first applying dabs or spots of an adhesive material between cover section 53 and the beam 51 indicated at 59 and 60 and positioning the cover section 53 against the beam. Thereafter, dabs of an adhesive material are applied between the cover section 52 and the beam 51 indicated at 75, 76 and 77 as well as a continuous longitudinal bead of adhesive material on the upper surface of portion 55 to form a seam at 57 and a continuous longitudinal bead of adhesive material on the lower surface of portion 56 to form a seam at 58 when the cover section 52 is in place as shown. This assembly has overlapping edge portions connected at the seams to form a pair of opposed, sealed, continuous seams along the cover. As previously stated, since this is a seam between cover sections the preferred adhesive material is made of the same material as the cover sections dissolved in a solvent which upon evaporation leaves a unitary or monocoque structure structure between sections joined end-to-end.

An adjustable form system for forming the cover sections above described shown in FIGS. 7–10 comprises a base 61 having a flat plate 62 of a preselected width for a preselected shape and size and demountable end plates 63 and 64 connected at the ends thereof forming a channel shape. At the ends or marginal side edges of the base there are releasably fastened two flange-forming members 66 and 67 designed for forming a cover for a selected size of beam or other structural shape. These flange-forming are removably fastened to the base by means of bolt fasteners 68 or the like disposed at spaced intervals along the base. The mold is shown to have a raised end portion 69 to form the corresponding raised end portion of the cover section illustrated in FIG. 3. The raised end portion may be a "celastic" material. Each flange-forming member has a selected maximum width dimension 71, depth dimension 72 and minimum width dimension 73 for forming a selected cover section. A preferred material for the base is a hard wood such as mahogany.

Figure 7:
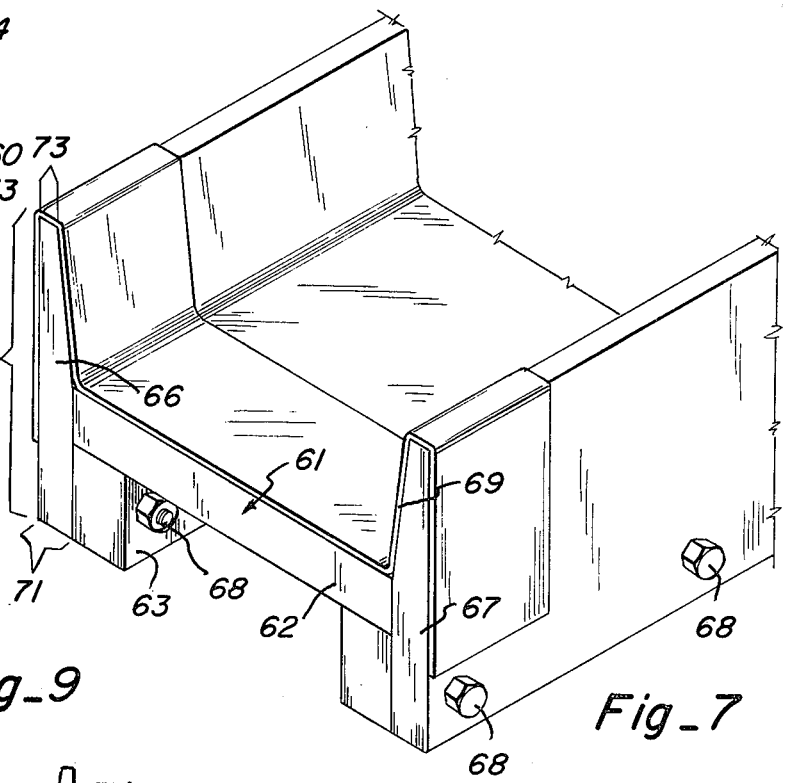
FIG. 7 is a perspective view of an adjustable form system for forming the cover sections shown in FIGS. 1–6.
Figure 10:
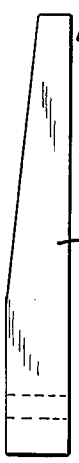
FIG. 10 is an end elevation view of one of a pair of flange-forming members interchangeable with the flange-forming members attached to the base of FIG. 7.
Figure 9:
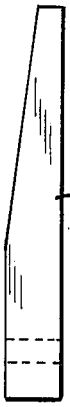
FIG. 9 is an end elevation view of one of a pair of flange-forming members interchangeable with the flange-forming members attached to the base of FIG. 7.
Figure 8:
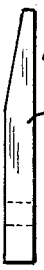
FIG. 8 is an end elevation view of one of a pair of flange-forming members interchangeable with the flange-forming members attached to the base shown in FIG. 7.

Referring now to FIGS. 8, 9 and 10, there are illustrated several additional interchangeable flange-forming members that will mount on the same base shown in FIG. 7. This arrangement affords the use of a single base with interchangeable flange-forming members to form cover sections for beams of a selected nominal size. Considering, for example, the W 12 size wide-flange beam, there are a number of different flange widths for that beam. For example, FIG. 8 could be a W 12×19 wide-flange beam having a flange width of 4.007 inches, FIG. 7 a W 12×45 wide-flange beam having a flange width of 8.042 inches, FIG. 9 a W 12×53 wide-flange beam having a flange width of 10 inches, and FIG. 10 a W 12×72 wide-flange beam having a flange width of 12.040 inches. Each of the flange-forming members has a different width, height and taper to accommodate the forming of a cover to enclose structural shapes having different flange widths, thicknesses and web depths, as above described.

From the foregoing description it is apparent that the coverings of the present invention afford a number of advantages including a range of sizes, shapes and thicknesses to meet specific needs and the preformed feature that eliminates expensive jobsite fabrication costs. There is also the feature of toughness that eliminates chipping, cracking, denting or peeling, and the thin-walled material is resistant to mold, fungus, corrosion, moisture, and certain acid or alkaline conditions. The cover assembly is completely sealed and usable both indoors and outdoors and sufficiently conforms to the shape of the structure covered so that it does not tend to sag or break away. In some applications it eliminates the need of stainless steel and it provides the strength for a steel beam while giving the more desirable appearance of a plastic structure.

Although the present invention has been described with a certain degree of particularity, it is understood that the present disclosure has been by way of example and that changes in details of structure may be made without departing from the spirit thereof.

What is claimed is:

1. A flexible protective cover section for covering a structural shape and the like comprising a corrosion-resistant body that is preformed to a set shape substantially conforming to at least a portion of external surfaces of a structural shape arranged along intersecting planes, said body having an intermediate body portion and a pair of oppositely inner side body portions arranged at an angle with and connected to said intermediate body portion at a flexural joint body portion that flexes to change the angle between said intermediate body portion and said inner side body portions so that said body adjusts to cover a range of structural shape dimensions, the thickness of said body being between about 0.020 and 0.090 inches.

2. A flexible protective cover section as set forth in claim 1 wherein each of said inner side body portions extends at an obtuse inside angle from opposite marginal edges of said intermediate body portion with said obtuse inside angle being changed as said joint body portions are flexed to cover the range of structural shape dimensions.

3. A flexible protective cover section as set forth in claim 1 wherein said body is sized for encompassing in excess of one half of the cross section of the structural shape to which it is applied.

4. A flexible protective cover section as set forth in claim 1 wherein each of said flexural joint body portions connecting said inner side body portions and said intermediate body portion is of an arcuate shape formed along a selected radius.

5. A flexible protective cover section as set forth in claim 1 wherein said body has a pair of outer side body portions each connected to and extending back over and in spaced relation to an associated of said inner side body portions.

6. A flexible cover section as set forth in claim 5 wherein each of said inner side body portions is connected to an associated outer side body portion by a corner body portion.

7. A flexible protective cover section as set forth in claim 1 wherein said body is made of a high-impact elastomeric material.

8. A flexible protective cover section as set forth in claim 1 wherein said body is substantially rigid and generally thin-walled.

9. A flexible cover section as set forth in claim 1 wherein said body is made of a polyvinylcholoride plastic.

10. A flexible cover section as set forth in claim 1 wherein said body is made of an acrylonitrile butadiene styrene plastic.

11. A flexible cover section as set forth in claim 1 wherein the wall thickness of said body is substantially uniform throughout said body.

12. A flexible cover section as set forth in claim 1 wherein said body has a raised end portion adapted to overlap a next adjacent cover section to connect said cover sections end-to-end.

13. A flexible protective cover section for covering structural shapes and the like comprising:

a generally thin-walled, plastic, corrosion-resistant body that is preformed to a set shape substantially conforming to outer surfaces of a structural shape arranged along intersecting planes and encompassing in excess of one half of the cross section of the structural shape, said body including an intermediate body portion for covering an external web surface of a structural shape;

a pair of oppositely disposed inner side body portions arranged at an angle with and connected at associated flexural joint body portions to the outer marginal edges of said intermediate body portion for covering a pair of opposed inner flange external surface portions of the structural shape, said inner side portions projecting at an obtuse inside angle from opposite edges of said intermediate body portion, said flexural joint body portions flexing to change the angle between said intermediate body portion and said inner side body portions so that the cover section adjusts to cover a range of structural shapes; and an outer side body portion connected by a corner body portion to and extending back from each of the opposite outer marginal edges of each of said inner side body portions for covering the outer flange surface portions of the structural shape, each of said outer side body portions extending past said intermediate body portion for an overlapping relation with a complementary outer side body portion of another similar cover section covering an opposite face of the structural shape, the thickness of said body being between about 0.020 and 0.090 inches.

14. In a protective cover assembly for covering structural shapes and the like, a protective covering generally conforming to the outer surface configuration of the structural shape, said protective covering including a pair of opposed, similarly shaped cover sections of selected lengths each preformed to a set shape substantially conforming to and covering in excess of one half of a structural shape to provide a pair of opposed overlapping portions at opposite edges, and a sealed, continuous seam joining said overlapping portions throughout the lengthwise extent thereof, each said cover section having an intermediate body portion and a pair of oppositely disposed inner side body portions arranged at an angle with and connected to said intermediate body portion at a flexural joint body portion that flexes to change the angle between said intermediate body portion and said inner side body portions so that the covering adjusts to cover a range of structural shape dimensions, the thickness of each of said covering sections being between about 0.020 and 0.090 inches.

15. In a protective cover assembly as set forth in claim 14 wherein said sealed continuous seams are of the same material as said cover sections and form a unitary monocoque structure at said overlapping portions.

16. In a protective cover assembly as set forth in claim 14 wherein said covering includes a second pair of opposed, similarly shaped, preformed cover sections of selected lengths each covering in excess of one half of a structural shape to provide a second pair of overlapping edge portions at opposite edges and connected at opposed continuous seams, said second pair of opposed cover sections being connected at a circumferentially sealed continuous seam with the first-mentioned pair of cover sections.

17. In a protective cover assembly as set forth in claim 16 wherein said second pair of cover sections has a raised end portion that overlaps an end portion of said first-mentioned pair of cover sections and said circumferentially sealed continuous seam is formed between said raised end portion and said end portion of said first-mentioned pair of cover sections.

18. In combination with a structural shape having a web portion and a pair of opposed flange portions, a protective covering over said structural shape fully sealed off from the atmosphere, said protective covering including a pair of opposed, similarly shaped cover sections each preformed to a set shape substantially conforming to and covering in excess of one half of a structural shape to provide a pair of opposed overlapping portions at opposite edges, a sealed continuous seam joining each of said overlapping portions throughout the lengthwise extent thereof, each said cover section having an intermediate body portion and a pair of oppositely disposed inner side portions arranged at an angle with and connected to said intermediate body portion at a flexural joint body portion that flexes under pressure to change the angle between said intermediate body portion and said inner side body portions so that the cover sections adjust to cover a range of structural shape dimensions, an inner of said cover sections being adhesively secured to an exterior surface of one of said flange portions and to an external surface of said web, an outer of said cover sections being adhesively secured to said inner cover section along a pair of opposed, sealed, continuous seams and to the opposite surface of said web, and connecting means between the ends of said covering and said beam forming a sealed continuous bead to close off the ends of said covering, the thickness of each of said covering sections being between about 0.020 and 0.090 inches.

19. In combination as set forth in claim 18 wherein said connecting means is in the form of an adhesive that flexes to allow for contraction and expansion.

20. An adjustable form system for making flexible protective covering sections having a thickness between about 0.020 and 0.090 inches for structural shapes comprising:

a base of a preselected width for a preselected structural shape size, and one of a selected plurality of pairs of interchangeable flange-forming members for a selected structural shape size removably fastened to the opposite side edges of the base and extending generally normal thereto, each said flange-forming member having a selected width and a selected height for a selected flange dimension.

21. An adjustable form system as set forth in claim 1 wherein said base and flange-forming members have a strip of raised portion at one end for forming a corresponding raised portion in the covering section formed thereon.

* * * * *

UNITED STATES PATENT AND TRADEMARK OFFICE

CERTIFICATE OF CORRECTION

PATENT NO. : 4,081,941

DATED : April 4, 1978

INVENTOR(S) : James G. Van Ausdall

It is certified that error appears in the above-identified patent and that said Letters Patent are hereby corrected as shown below:

Col. 1, line 42, after "paint" insert --and--

Col. 2, lines 37-38 should not be indented

Col. 2, line 66, change "structure" to --structural--

Col. 3, line 24, before "24" change "portion" to --portions--

Line 30, before "side" change "the" to --one--

Line 32, after "to" insert --have--

Col. 4, lines 19-20, delete "preferably a rubber adhesive material,"

Col. 6, line 19, after "cover" insert --section--

Line 50 (claim 1, line 7), before "inner" insert --disposed--

Signed and Sealed this

*Twenty-sixth* Day of *December 1978*

[SEAL]

*Attest:*

RUTH C. MASON
*Attesting Officer*

DONALD W. BANNER
*Commissioner of Patents and Trademarks*